US007081423B2

(12) United States Patent
Abed et al.

(10) Patent No.: US 7,081,423 B2
(45) Date of Patent: Jul. 25, 2006

(54) NONWOVEN ABSORBENT MATERIALS MADE WITH CELLULOSE ESTER CONTAINING BICOMPONENT FIBERS

(75) Inventors: Jean-Claude Abed, Charlotte, NC (US); Denis G. Fallon, Rock Hill, SC (US)

(73) Assignee: Celanese Acetate LLC, Charlotte, NC (US)

( * ) Notice: Subject to any disclaimer, the term of this patent is extended or adjusted under 35 U.S.C. 154(b) by 684 days.

(21) Appl. No.: 10/180,228

(22) Filed: Jun. 26, 2002

(65) Prior Publication Data

US 2002/0177379 A1 Nov. 28, 2002

Related U.S. Application Data

(63) Continuation of application No. 09/655,502, filed on Sep. 5, 2000, now abandoned.

(51) Int. Cl.

| | |
|---|---|
| ***D04H 1/00*** | (2006.01) |
| ***D04H 13/00*** | (2006.01) |
| ***D04H 3/00*** | (2006.01) |
| ***D04H 5/00*** | (2006.01) |

(52) U.S. Cl. ..... 442/361; 442/340; 442/360; 442/362; 442/364; 428/373

(58) Field of Classification Search ..... 442/340, 442/360, 361, 362, 364; 428/373
See application file for complete search history.

(56) References Cited

U.S. PATENT DOCUMENTS

| | | | |
|---|---|---|---|
| 4,189,511 | A | 2/1980 | Levers et al. |
| 4,435,239 | A | 3/1984 | Harris |
| 4,468,845 | A | 9/1984 | Harris |
| 5,509,430 | A | 4/1996 | Berger |
| 5,672,419 | A | 9/1997 | Mukaida et al. |

OTHER PUBLICATIONS

"Encyclopedia of Polymer Science and Engineering," vol. 6, John Wiley & Sons (New York), p. 830-831, (1986).
"Encyclopedia of Polymer Science and Engineering," vol. 10, John Wiley & Sons (New York), p. 204-253, (1987).
S. P. Hersh, Polyblend Fibers, "High Technology Fibers," Marcel Dekker, Inc. (New York), p. 1-47, (1985).

*Primary Examiner*—Norca Torres
(74) *Attorney, Agent, or Firm*—Hammer & Hanf, P.C.

(57) ABSTRACT

The invention is directed to a nonwoven material made of a bicomponent fiber in which the first polymer is a cellulose ester polymer, preferably cellulose acetate, and the second polymer is selected from the group consisting of polyolefins, polyesters, polyamides and polyimides. The bicomponent fiber can be either a side-by-side or a core-and-sheath fibers. When core-and-sheath, the cellulose acetate is the sheath polymer. The nonwoven material of the invention can be used to prepare grips, materials for use in absorbent products such as diapers and personal hygiene products, disposable towels and other products. The nonwoven of the invention has particular utility for disposable diaper products due to the superior fluid acquisition, retention and distribution properties of the cellulose ester, yet avoids the high cost of all cellulose acetate fibers by use of a much less expensive second polymer to form part the bicomponent fiber.

24 Claims, No Drawings

NONWOVEN ABSORBENT MATERIALS MADE WITH CELLULOSE ESTER CONTAINING BICOMPONENT FIBERS

RELATED APPLICATION

The instant application is a continuation of U.S. application Ser. No. 09/655,502 filed Sep. 5, 2000, now abandoned.

FIELD OF THE INVENTION

The invention relates to nonwoven materials made using a cellulose acetate containing bicomponent fiber. In particular, the invention relates to nonwoven materials for use in absorbent products, wherein the nonwoven material is formed by any method known in the art from a bicomponent fiber comprising a cellulose ester as a first polymer material and a second polymer material of different chemical nature.

BACKGROUND OF THE INVENTION

Bicomponent fibers are known in the art, and such bicomponent fibers, as the term is used herein, comprise two polymer materials of different chemical nature which are combined in some fashion such that each of the two polymers is discretely identifiable in a particular portion of the overall fiber structure. Examples include core-and-sheath fibers, side-by-side fibers, and island-in the-sea fiber among others. While such bicomponent fibers are generally made of combinations of polyesters, polyamides, polyamides, liquid crystalline polymers and others polymeric materials, at least one bicomponent fiber has been described which comprises cellulose acetate and a second polymer material.

U.S. Pat. No. 5,509,430 to Berger describes a core-and-sheath type bicomponent fiber in which a sheath of cellulose acetate surrounds a core of polypropylene. The bicomponent fiber is used to prepare tobacco smoke filter rods for use in cigarettes and other smoking products. Although cellulose acetate is an expensive material relative to other polymers such as polypropylene, it is used in such filters because its cost is offset by other factors such as having an acceptable filter efficiency, not significantly detracting from taste, having low resistance to draw and having sufficient, but not excessive, hardness.

Nonwoven products are also known in the art and such products have been made from many different materials including natural cellulose (e.g., wood pulp and cotton), polyolefins, polyesters and other polymeric materials. Examples of such products include disposable towels, diapers and other hygiene products. Since such nonwoven products are usually disposable, cellulose esters have not generally been used because of the cost of the cellulose ester material. For similar reasons related to the cost of the cellulose esters, bicomponent fibers having a cellulose ester sheath have not been prepared and used in such products. Lastly, because cellulose ester fibers are generally of low strength relative to other fibers such as polyolefins and polyesters, the cellulose ester fibers often cannot be used on high speed manufacturing machines because they undergo excessive breakage resulting in manufacturing downtime. However, because cellulose esters have certain desirable properties, particularly with regard to fluid acquisition and absorption, and the ability wick fluids from one site to another, cellulose ester fibers and cellulose ester sheathed bicomponent fibers present unique opportunities in the preparation of nonwoven materials.

Accordingly, one purpose of this invention is to describe nonwoven materials and methods of preparing same which utilize bicomponent fibers comprising a first cellulose ester polymer and a second, different polymer.

Another purpose of this invention is to describe nonwoven materials and methods of preparing same which utilize core-and-sheath bicomponent fibers having a sheath of a first cellulose ester polymer and a core of a second, different polymer.

In addition, it is also the purpose of this invention to describe absorbent products made of nonwoven materials which have improved fluid acquisition, distribution and retention properties due to the utilization of a bicomponent fiber comprising a first cellulose ester polymer and a second, different polymer.

SUMMARY OF THE INVENTION

The present invention is directed to a nonwoven material prepared using a core-and-sheath or side-by-side bicomponent fiber comprising a first plasticized or un-plasticized cellulose ester polymer and a second different polymer material. The resulting bicomponent fibers may be used as a single filaments, a tow of a plurality of filaments, or as a staple or short fiber made from such bicomponent fibers. The bicomponent fibers can have any cross-section characteristics, for example, round, Y- or X-shaped, trilobal and similar shapes known in the art. The only restriction on the selected form of the bicomponent fiber is that the cellulose ester part of the bicomponent fiber be accessible to fluids such as air, water and other liquids.

DETAILED DESCRIPTION OF THE INVENTION

The teachings of all patents and publications cited herein are incorporated herein by reference. All percentages are weight percentages (wt. %) unless specified otherwise.

The term "bicomponent fiber" as used herein means a fiber made of two polymer materials of different chemical nature which are combined in some fashion such that each of the two polymers is discretely identifiable in a particular portion of the overall fiber structure, and the term is inclusive of filaments, staple and short fiber products. While many forms of bicomponent fibers are possible, the preferred forms for use in the instant invention are core-and-sheath ("core/sheath") and side-by-side ("side/side") bicomponent fibers. The only restriction on the selected form is that the cellulose ester part of the bicomponent fiber be accessible to fluids such as air, water and other liquids. Consequently, any bicomponent fiber in which the cellulose ester is covered or masked by the second polymer, and thus not accessible to air, water or other liquids, is excluded. The bicomponent fiber can be of any cross-section shape, for example, round, X- or Y-shaped, trilobal, elliptical, and any similar shape which can be prepared. Preferred forms are those which have a high surface area so as to maximize the fluid adsorption, retention and transport properties of the cellulose ester.

The cellulose ester polymer (the "first polymer component") used in preparing the bicomponent fiber used in practicing the invention can be any cellulose ester formed by the esterification of cellulose, which has three hydroxyl groups per β(1→anhydroglucose ring, with a $C_2$–$C_8$ alkyl carboxylic acid. $C_2$–$C_4$ carboxylic acids are preferred. The preferred cellulose ester is cellulose acetate having a Degree of Substitution (DS) in the range of about 1.5 to about 3.0, and preferably in the range of about 1.7 to about 2.6. DS refers to the average number of the cellulose anhydroglucose ring hydroxyl group hydrogen atoms which have been replaced by the carboxylate moiety. There are three such hydroxyl groups per ring. The cellulose ester polymer can be used without or with additives such as plasticizers, colorants, lubricants and similar additives known to those skilled in the art.

Any known cellulose ester plasticizer can we used in practicing the invention. Examples, without limit, of plasticizers which can be used with cellulose acetate include triacetin, triethyl citrate, dimethyl ethyl phthalate, the dimethyl ethers of triethylene or tetraethylene glycol, Venice turpentine, Canada balsa, glycerin, gum elemi, and similar cellulose acetate plasticizers known to those skilled in the art.

The second polymer component used in preparing the bicomponent fiber used in practicing the invention can be any polymer selected from the group consisting of polyolefins (for example, polyethylene and polypropylene), polyester (for example, polyethylene terephthalate and polytrimethylene terephthalate) and polyamides (for example, nylon 66). Preferred second component polymers are polypropylene and polyethylene terephthalate. The second polymer component can be used without or with additives such as plasticizers, colorants, lubricants and similar additives known to those skilled in the art.

The diameter of the of the bicomponent fiber used in practicing the invention can be any diameter suitable for the preparation of nonwoven materials. The diameter can range is from about 1 to about 50 microns, with a preferred range of about 1 to about 20 microns, and a most preferred range of about 1 to about 10 microns. For non-round bicomponent fibers, for example, trilobal or X-shaped fibers, the diameter is measured across a circle circumscribing the outer edges of the fiber, for example, ⊗.

The bicomponent fibers used in practicing the invention can be prepared by any method known in the art suitable for preparing bicomponent fibers and such methods are not part of the invention. For example, the bicomponent fiber can be prepared by melt extrusion of the first and second polymer components, or by first extruding or solution spinning the second polymer component followed by immersing, once or a plurality or times, the resulting second polymer component fiber in a cellulose ester solution or melt to thereby coat the second polymer fiber with the cellulose ester. Methods of preparing bicomponent fibers have been described in the Berger patent cited above; in the *Encyclopedia of Polymer Science and Engineering*, Volume 6 (New York, Wiley-Interscience, 1987), pages 830–831, and citations given therein; in S. P. Hersh, "Polyblend Fibers," *High Fiber Technology*, Part A (New York, Marcel Dekker, 1985), pages 1–47, and in U.S. Pat. No. 4,189,511 to Levers et al. (coating a polypropylene core with an acetone dope of cellulose acetate to prepare a cigarette tow having a cellulose sheath; incorporated herein by reference). The bicomponent fibers can be used in continuous fiber form, for example, as a tow of fibers, to form a nonwoven material or they can be cut into staple or short fibers and formed into a nonwoven material by conventional methods. The bicomponent fibers used in practicing the invention are 10–90% core material and 90–10% sheath (e.g., cellulose acetate) material. The preferred bicomponent fibers being about 50 to about 90% core material and about 10 to about 50% sheath material (e.g. cellulose acetate) to minimize cost.

Subsequent to preparing the bicomponent fiber, the fiber is made into a nonwoven material by any method known in the art. Methods of preparing nonwoven material are described in the *Encyclopedia of Polymer Science and Engineering*, Volume 10, (New York, Wiley-Interscience, 1987), pages 204–253 and citations given therein. Continuous bicomponent fibers can be formed into a nonwoven material immediately after formation, for example, by the spunbond process after melt extrusion (ibid., page 214). A plurality of individual bicomponent fibers can also be combined to form a "tow" of fibers, with or without crimping, though preferably with crimping, which can then be opened and formed into a nonwoven material using either threaded rollers or an air jet as described in U.S. Pat. Nos. 4,435,239 and 4,468,845. Staple and short fibers can be formed into nonwoven materials by conventional methods, for example, carding, air-laying, wet-forming and dry-forming.

Various substances (for example, superabsorbent polymers (SAP), adhesives, fibrous pulp, charcoal, talc, and other substances known in the art as being added to nonwoven materials) can be added to the nonwoven material either during formation or afterwards. For example, during wet-forming with short bicomponent fibers, a superabsorbent polymer (SAP) can be added to the forming solution before forming. The formed, SAP-containing nonwoven is then dried and subsequently used to make absorbent products. In continuous nonwoven formation using a melt extruded bicomponent fiber, SAP, wood pulp and similar substances known in the art can be applied or added to the nonwoven as it is laid down. Typical application methods include gravity feeding and air blowing after lay-down, with or without vibration of the nonwoven, to distribute the applied material throughout the nonwoven structure. These same substance application methods can be used with nonwoven materials formed from a tow of fibers using threaded rollers or air jets.

EXAMPLE 1

A bicomponent fiber of round cross section having a polypropylene (PP) core and a plasticized cellulose acetate (CA) sheath is prepared by melt extrusion and is continuously laid down to form a nonwoven material. The fiber is 50/50 wt. % PP/CA. Subsequent to lay-down, SAP is gravity fed onto the nonwoven which is then vibrated to distribute the SAP throughout the nonwoven structure. The SAP-containing nonwoven is then fed to a diaper making apparatus to be formed into a diaper. The resulting diaper is found to have better fluid acquisition, distribution and retention properties than conventional diapers, thereby preventing leakage and minimizing fluid/skin contact time.

If the nonwoven is to be used as a self-adhesive grip material, subsequent to lay-down the bicomponent fibers may optionally be entangled by needle-punching or hydroentangling, an adhesive applied on one face nonwoven, and a removable cover sheet may be placed over the adhesive. The resulting self-adhesive nonwoven is then cut to size, packaged and sold as a grip for use on sports equipment, tools, and similar application requiring grips. The advantage of the grip is that the CA sheath material wicks moisture away from the surface of the grip thereby providing less slippage than conventional grips.

EXAMPLE 2

A polyethylene terephthalate (PET) fiber having a trilobal or X-shaped cross section is melt spun by conventional methods or is purchased commercially. The PET fiber is passed through a cellulose acetate/acetone solution (about 6 to about 30 wt. % CA; no plasticizer) followed by solvent removal, for example, by evaporation in a warmed (35–75° C.) atmosphere or application of a warmed air stream). If necessary, the CA acquisition and solvent removal steps is repeated a plurality times until the desired amount of CA has been acquired. Subsequent to acquisition of CA, the resulting bicomponent fiber is laid down to form a nonwoven material. If desired, the final drying step can be eliminated and the "wet" CA/PET fiber laid down, followed by subsequent drying. This procedure promotes inter-fiber bonding in the nonwoven material and may minimize or eliminate the need to the use entangling methods, for example, needle-punching or hydroentangling. Wood pulp is then applied to nonwoven material which is then vibrated to distribute the pulp throughout the structure. The resulting wood pulp containing nonwoven is then fed to a diaper making machine for formation into diapers.

Solvents suitable for use in preparing the CA solution or dope, in addition to acetone, include methyl ethyl ketone and higher aliphatic ketones, methylene dichloride and other chlorinated hydrocarbons, dimethyl sulfoxide, tetrahydrofuran an other solvents known in the art to dissolve CA. The concentration of CA in the dope or solution may be from about 3 to about 40 wt %, preferably about 6 to about 30 wt. %. When using this procedure, caution should be taken regarding the combination of solvent and core fiber to avoid dissolving the core fiber or overly tackfying it. Problems can be avoided by adjusting the contact time, evaporating temperatures and other processing parameters. The CA/PET nonwoven material can also be used to prepare "wet wipe" type towels, grips, shoe and boot inserts, and similar products.

EXAMPLE 3

A CA/PP bicomponent fiber is prepared as in Example 1. The resulting fiber is then cut or chopped into a staple fiber which is used to prepare an air-laid nonwoven material using known procedures. The resulting nonwoven material is used to prepare disposable towels.

EXAMPLE 4

A bicomponent fiber of round cross section having a polypropylene (PP) core and a plasticized cellulose acetate (CA) sheath is prepared by melt blown extrusion, and is continuously laid down to form a non-woven material. The fiber is 50/50 wt. % PP/CA. Melt blowing technology used for bicomponent fibers is well known, and is described, for example, in U.S. Pat. No. 5,509,430 to Berger. Subsequent to lay-down, SAP is gravity fed onto the non-woven, which is then vibrated to distribute the SAP throughout the non-woven structure. The SAP-containing non-woven is then fed to a diaper making apparatus to be formed into a diaper. The resulting diaper is found to have better fluid acquisition, distribution and retention properties than conventional diapers, thereby preventing leakage and minimizing fluid/skin contact time.

EXAMPLE 5

A CA/PP bicomponent fiber is prepared as in Example 4. The resulting fiber is then cut or chopped, and used to prepare an air-laid non-woven material using known procedures. The resulting non-woven material is used to prepare disposable towels.

EXAMPLE 6

A 50/50 wt. % CA/PP bicomponent fibers is prepared and laid down using the spunbond process to form a nonwoven material. SAP is gravity fed as described in Example 1 and the resulting SAP-containing nonwoven material is used to prepare diapers.

The foregoing Examples have been given illustrate the invention and not for purposes of limiting the broader concepts of the invention. Variations within the ability of those skilled in the art are to be understood as being encompassed within the broad concepts and are included therein.

We claim:

1. A method for the production of a nonwoven product comprising the steps of:

providing a nonwoven material having a bicomponent fiber of a cellulose ester polymer and a second polymer selected from the group consisting of polyolefins, polyesters, polyamides, and polyimides; where said bicomponent fiber is either a core-and-sheath fiber or a side-by-side fiber;

forming a nonwoven product from said nonwoven material where said nonwoven product is selected from the group consisting of: disposable towels; diapers; hygienic products; grips; "wet wipe" type towels; and inserts for shoes and boots.

2. The method of claim 1 wherein said bicomponent fiber being said core-and-sheath fiber.

3. The method of claim 2 wherein said cellulose ester polymer comprising said sheath of said bicomponent fiber.

4. The method of claim 1 wherein said bicomponent fiber comprises about 10 to about 90 weight percent of said cellulose ester polymer and about 90 to about 10 weight percent of said second polymer.

5. The method of claim 4 wherein said bicomponent fiber comprises about 10 to about 50 weight percent cellulose ester polymer and about 50 to about 90 weight percent of said second polymer.

6. The method of claim 1 wherein said bicomponent fiber having a diameter in the range of about 1 to about 50 microns.

7. The method of claim 6 wherein said bicornponent fiber having a diameter in the range of about 1 to about 20 microns.

8. The method of claim 1 further comprising the steps of:

adding a superabsorbent polymer powder to said nonwoven material before forming the nonwoven product where the nonwoven product is selected from the group consisting of: diapers and hygienic products.

9. The method of claim 1 wherein said bicomponent fiber being a staple fiber.

10. The method of claim 1 wherein said cellulose ester polymer being a cellulose acetate polymer.

11. The method of claim 10 wherein said cellulose acetate polymer being a plasticized cellulose acetate polymer.

12. The method of claim 1 wherein said bicomponent fiber comprising about 10 to 50 weight percent cellulose acetate polymer sheath and about 50 to 90 weight percent polypropylene core.

13. A method of absorbing a liquid comprising the steps of:

providing a nonwoven material having a bicomponent fiber of a cellulose ester polymer and a second polymer selected from the group consisting of polyolefins, polyesters, polyamides, and polyimides; wherein said bicomponent fiber being either a core-and-sheath fiber or a side-by-side fiber where said nonwoven material is in a form of a nonwoven product, said nonwoven product is selected from the group consisting of: disposable towels; diapers; hygienic products; grips; "wet wipe" type towels; and inserts for shoes and boots;

providing a liquid; and contacting said liquid with said nonwoven material where said nonwoven material absorbs said liquid.

14. The method of claim 13 wherein said bicomponent fiber being said core-and-sheath fiber.

15. The method of claim 14 wherein said cellulose ester polymer comprising said sheath of said bicomponent fiber.

16. The method of claim 13 wherein said bicomponent fiber comprises about 10 to about 90 weight percent of said cellulose ester polymer and about 90 to about 10 weight percent of said second polymer.

17. The method of claim 16 wherein said bicomponent fiber comprises about 10 to about 50 weight percent cellulose ester polymer and about 50 to about 90 weight percent of said second polymer.

18. The method of claim 13 wherein said bicomponent fiber having a diameter in the range of about 1 to about 50 microns.

19. The method of claim 18 wherein said bicomponent fiber having a diameter in the range of about 1 to about 20 microns.

20. The method of claim 13 wherein said nonwoven material includes a superabsorbent polymer powder.

21. The method of claim 13 wherein said bicomponent fiber being a staple fiber.

22. The method of claim 13 wherein said cellulose ester polymer being a cellulose acetate polymer.

23. The method of claim 22 wherein said cellulose acetate polymer being a plasticized cellulose acetate polymer.

24. The method of claim 13 wherein said bicomponent fiber comprising about 10 to 50 weight percent cellulose acetate polymer sheath and about 50 to 90 weight percent polypropylene core.

* * * * *